US005895097A

United States Patent [19]

Heintzmann et al.

[11] Patent Number: 5,895,097

[45] Date of Patent: Apr. 20, 1999

[54] CONTINUOUSLY OPERATING MINING MACHINE FOR SIMULTANEOUS EXCAVATION AND CONVEYING OF COAL

[75] Inventors: Peter Heintzmann, Bochum; Kuno Guse, Witten; Friedel Amling, Gelsenkirchen, all of Germany

[73] Assignee: Bochumer Eisenhutte Heintzmann GmbH & Co. KG, Bochum, Germany

[21] Appl. No.: 08/846,071

[22] Filed: Apr. 25, 1997

[30] Foreign Application Priority Data

Apr. 27, 1996 [DE] Germany ..... 196 16 931

[51] Int. Cl.[6] ..... E21C 25/56

[52] U.S. Cl. ..... 299/34.07

[58] Field of Search ..... 299/34.01, 34.07, 299/34.12, 34.1

[56] References Cited

U.S. PATENT DOCUMENTS 5,088,796 2/1992 Plaga ..... 299/34.1
5,181,766 1/1993 Heintzmann et al. ..... 299/34.1
5,647,640 7/1997 Heintzmann et al. ..... 299/34.07

FOREIGN PATENT DOCUMENTS 35 45 302 7/1987 Germany .
40 04 488 8/1991 Germany .
2252778 8/1992 United Kingdom ..... 299/34.1

*Primary Examiner*—David J. Bagnell
*Attorney, Agent, or Firm*—Herbert Dubno

[57] ABSTRACT

A mining machine for excavating coal along a coal front of a seam in which a chain displaces excavating tools along an excavating stretch at a leading side across the coal face and a conveying stretch is provided rearwardly thereof, the stretch terminating in direction reversal stations with wheels at opposite ends of the stretches. A linear drive for at least one of the wheels can extend in a gallery alongside the mined cut. According to the invention, the excavating conveyer bottom is at an angular of 70° to 130° to the bottom of the conveying trough and the shafts of the wheels are inclined to the vertical forwardly and upwardly to include angles of 10° to 45°.

12 Claims, 6 Drawing Sheets

COMPUTER
FROM DETECTOR
SAG DETECTOR
2
6
7
9
25
26
27
29

CONTINUOUSLY OPERATING MINING MACHINE FOR SIMULTANEOUS EXCAVATION AND CONVEYING OF COAL

FIELD OF THE INVENTION

The present invention relates to a continuously operating mining machine for the simultaneous excavation and conveying of coal and, more particularly, to a machine of the type in which an endless chain is displaced along an excavating trough at the leading side of the machine and a conveying trough at the trailing side of the machine, the chain and corresponding excavating tools which tear at the coal face or coal front, and, at opposite ends of the excavating and conveying stretches, conical or like reversing wheels are provided about which the chain and tools can pass.

BACKGROUND OF THE INVENTION

Mining machines of the aforedescribed type have been provided heretofore, especially for excavating narrow seams by attacking the coal face in a relatively wide cut which corresponds, for example, to at least a portion of the length of the two stretches. The machine is advanced in the direction of the coal face, i.e. transversely to the two stretches, and the coal is excavated by picks or the like of the tools and the excavated material is displaced along the conveying trough to one or the other end of the machine, e.g. into a gallery, tunnel or the like from which the conveyed material can be carried off.

At least one drive unit can be provided for one of the reversing wheels around which the chain passes and can comprise an electric motor and a transmission. The drive station provides a certain tension at least in the excavating stretch for the chain.

In conventional long-wall mining, socalled walking units are commonly provided such that the supported or propped parts were braced upon those riding on the floor of the cut and the advance of the excavating unit is effected in a step-like manner. The trailing part of the machine is thus drawn along after the leading part has been moved forwardly. The resulting excavation, which ultimately deposits the excavated coal in a gallery alongside the cut, requires step like advance of the leading side of the machines at a rate which will follow the plowing of the coal from the seam so that the plows or tools will not have nonworking passes.

The conveyor operates like a flight conveyor, utilizing the same tools to shift the excavated material which falls into the conveying trough toward the end of the machine and into a gallery.

Machines of this type are known from, for example, DE 35 45 302 C2 and DE 40 04 488 and can have various configurations. They have been found to be largely satisfactory and to provide significant rates of removal of the material, i.e. mined coal per unit time. However, in spite of the success of such machines, it has become desirable to further improve the mining efficiency.

One of the problems with conventional systems appears to be the frictional loss which arises in the conveying and excavating troughs and the work in advancing the excavating part and the drawing of the trailing part of the machine thereafter.

Furthermore, the conventional mining machine must have a fairly large cross section and span a substantial length, all of which have posed problems with respect to stability of the machine. In the conventional systems with such machines, undercutting of the coal itself to allow the coal to then drop into the conveying trough was limited and by and large the tools had to be dimensioned to plow coal from the full thickness or height of the coal seam.

OBJECTS OF THE INVENTION

It is the principal object of the present invention to provide a compact mining machine which can operate with high efficiency, especially for coal seams.

Another object of the invention is to provide an improved mining machine and especially a long-wall mining machine which is more compact than conventional machines and yet is as efficient or more efficient than the conventional machines.

It is also an object of this invention to provide an improved mining machine which eliminates drawbacks of earlier machines.

SUMMARY OF THE INVENTION

These objects and others which will become apparent hereinafter are attained, in accordance with the invention by providing, in a machine of the type described, that the excavation trough bottom is at an angle of 70° to 130°, preferably about 100°, to the bottom of the conveyor trough and forms a support rail for the unit consisting of the two troughs, the conveyor trough being formed along its side remote from the coal front, an edge support which rides upon the floor of the cut. The tools are provided so that they undercut the coal front. Furthermore, the shafts of the reversal wheels, i.e. the wheels at which the chain changes direction from the excavating stretch to the conveying stretch and vice versa, are inclined relative to the vertical by 10° to 40°, preferably about 35°, from the bottom downwardly and upwardly in the direction of advance of the machine against the coal front. Finally, according to this invention, the motor/transmission unit is braced against and rides upon the floor of the respective gallery while the shaft of the driven wheel is connected via a bevel gearing with the transmission of the drive unit.

Preferably two such drive units extend in respective galleries at opposite ends of the mining cut.

In particular, the mining machine of the invention can comprise:

an elongated machine body extending between the galleries and provided with an endless chain carrying coal-excavating tools and adapted to be advanced against a coal face, the chain having an excavating stretch engaging the face and displaced in an excavating trough of the body and a conveying stretch displaced in a conveying trough of the body rearwardly of the excavating trough with respect to a direction of advance of the body, thereby excavating coal from the seam to form a cut and transferring excavated coal to one of the galleries;

respective direction-reversing wheels around which the chain passes at opposite ends of the stretches and at which the chain passes respectively from the excavating stretch to the conveying stretch and from the conveying stretch to the excavating stretch;

at least one drive unit operatively connected to one of the wheels, located in a respective one of the galleries and supported on a floor thereof, the drive unit comprising an electric motor and a transmission connected between the electric motor and the one of the wheels for driving the chain along the stretches, the excavating trough having an excavating trough bottom at an angle of 70° to 130° to a bottom of the conveying trough and forming a reinforcing rail for the body, the conveying trough being formed on side thereof opposite the excavating trough with a bearing edge supporting the body on a floor of the cut, the excavating stretch being positioned to undercut the coal seam, the wheels having shafts inclined upwardly and forwardly at angle of 10° to 40° to the vertical; and bevel gearing connecting the transmission to the aforementioned one of the wheels.

The invention is based upon the fact that with a mining machine according to the invention, the excavation of coal can be greatly accelerated because the tools undercut the coal front with simultaneously a reduction of the cross section in the direction of the seam and cut and therefore a more compact construction.

The function of the excavation tools and any additionally supplied flights for use as conveyor elements is not adversely effected by the more compact construction. Indeed, with the more compact construction, there was a reduction in friction losses at least in part resulting from the orientation of the reversing wheel shafts and the fact that the or each drive unit is supported on the floor of the respective gallery. The reversal stations also may be supported on the floor on the cut or respective galleries. If the advance of the machine requires subsequent movement of the drive units in the feed direction or the entire assembly is advanced continuously against the coal front, the support of the drive unit or units on the floor of the gallery greatly simplifies the advance.

The invention provides the conveyer trough and the excavating trough in optimum positions for the excavation and continuous advance of the unit while insuring a highly stable structure which can be so advanced. The excavating and conveyer stretches are statically determined in their respective orientations and thus stress in the system can be reduced along with friction tosses. The chain tension can thus be maintained and optimized at least at the excavation stretch to increase the efficiency of the excavating step.

According to a feature of the invention, the orientation of the tools can be less than 90° with respect to the horizontal floor for undercutting the coal front.

The electric motor/transmission unit forming the drive on one or both ends of the stretches can extend linearly along the respective gallery or along or parallel to the conveyer stretch. In either of these embodiments, advance of the apparatus is promoted and the excavation efficiency increased.

According to a further feature of the invention, the tool elements have an angle of attack of about 80° to effect a corresponding undercut. This angle allows the tools to pass with reduced friction losses through the reversal stations, at least one of which is formed as a drive station.

According to yet another feature of the invention, the or each driven wheel has its shaft extending into a driven bevel gear which meshes with a drive bevel gear of a respective motor/transmission unit, the driving bevel gear lying along an axis parallel to or being coaxial with the motor axis. The kinematic inverse is also possible whereby the shaft extending to the respective reversal projects from the bevel gear.

To simplify the displacement of the machine, the picks of the tools which, in the region of the reversal wheels are oriented substantially horizontally or prone, project beyond the outlines of the reversal wheels and the transmission housings and the reversal wheel axes are so inclined to the vertical, that these tools or picks at the deepest portions of their respective circulating paths create a free cut region along the floor along which the machine frame can glide on respective skids. In this manner, the reversal and drive stations are by and large advanced when the unit formed by the conveyor trough and the excavating trough are advanced.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another, refer to structure that is functionally if not structurally identical. In the accompanying drawing.

SPECIFIC DESCRIPTION

Figure 1:
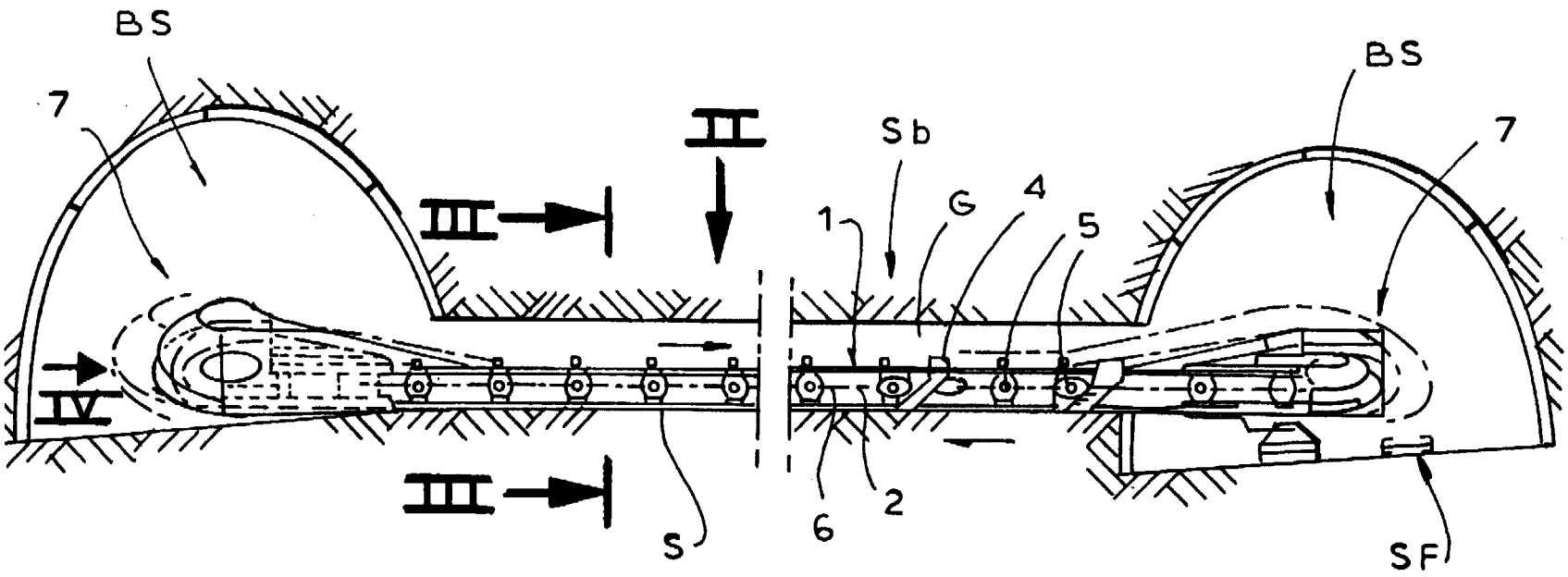
FIG 1 a section through a coal mine showing the mining machine in elevation but in a highly diagrammatic form.
Figure 2:
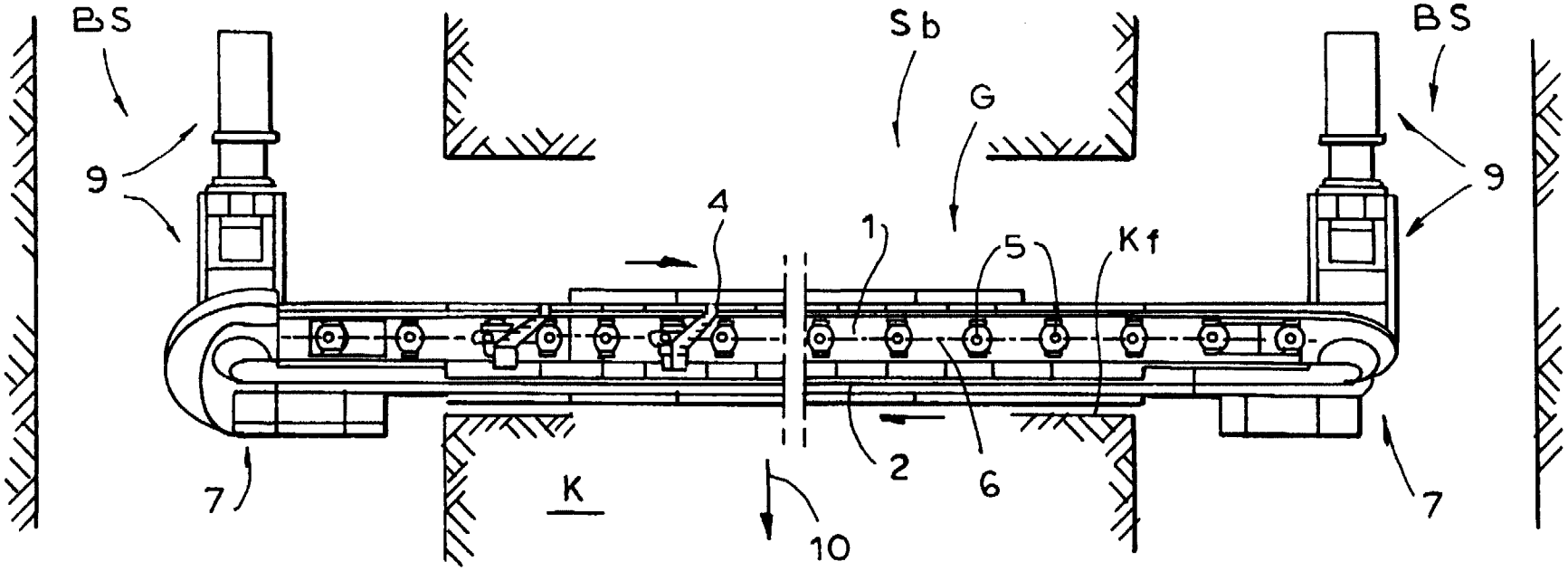
FIG. 2 is a plan view of the machine of FIG. 1 taken in the direction of the arrow II thereof and in the setting of a mine showing the mine tunnels and mining face.

The mining machine G shown in FIGS. 1 and 2 is used for the excavation and transport of a mined product, for example, coal K in a seam along a coal front Kf via a mining tunnel or cut Sb which is provided between two service tunnels BS. The mining machine G is intended to operate continuously and to displace coal cut from the coal front Kf of a seam into one of the service tunnels BS in which a conveyor SF is provided for carrying the excavating coal back along the respective gallery or tunnel to a location at which it can be delivered to the surface by conventional means.

The mining machine G comprises an endless chain having a conveyor stretch 1 and an excavating stretch 2. Each of these stretches is formed with a respective trough and the excavating stretch 2 is connected with the conveyor stretch 1 and oriented at a predetermined angle 3 to the coal front Kf. The angle 3 is adjustable (see FIG. 3). In the conveyor stretch 1 and in the excavating stretch 2, the cutting tools or plows 4 are provided for tearing the coal from the coal front. In addition to the cutting tools 4, the endless chain can also carry conveyor elements 5. The endless chain which is displaceable along the two stretches, has been represented at 6.

The conveyor stretch 1 and the excavating stretch 2 of the mining machine G have a working region along the coal front Kf and can move in the longitudinal direction of the mining tunnels and galleries. At the working region and in the service galleries BS, respective reversing stations 7 are provided at which the chain 6 reverses direction. The reversing stations 7 can each have conical reversing wheels 8.

At least one of the reversing stations 7 is provided with electric motor/transmission unit 9 which forms a drive station. In general, both reversing stations are drive stations, meaning that each has a motor/transmission unit as described. In addition, one or more tensioning stations can be provided for maintaining tension in the chain 6. The chain 6, the excavating elements or tools 4 and, if desired, also the conveyor elements 5 can be driven, the tools being entrained with the chain 6. The mining machine G is advanced in the direction of arrow 10 into the coal face Kf in a step-by-step manner, matching the excavation of coal. The system for advancing the mining machine has not been shown.

Figure 3:
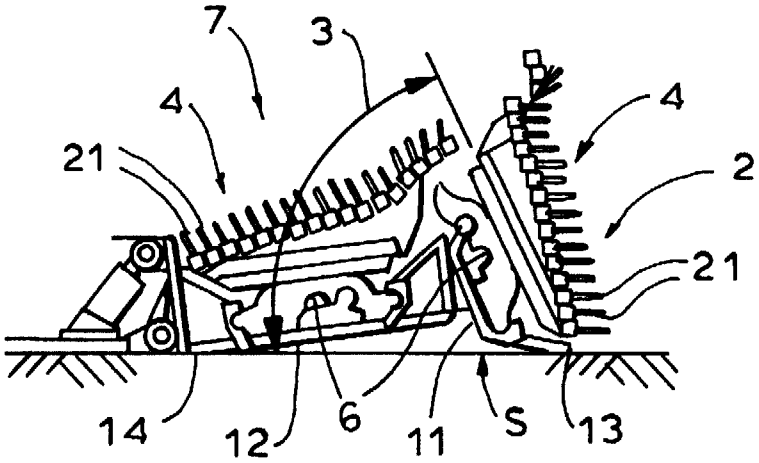
FIG. 3 is an enlarged cross sectional view corresponding generally to a section along the line III—III of FIG. 1.

From FIG. 3 it will be apparent that the bottom 11 of the trough for the excavation stretch is at an angle of about 70° to 130° and preferably an angle of about 100° to the floor 12 of the trough for the conveyor stretch, so that the troughs for the conveyor stretch 1 and the excavating stretch 2 form a support rail 13. The conveyor trough at the side remote from the coal front, has an angled edge 14 riding on the floor of the cut.

The excavating tools 4 undercut the coal front Kf. In this embodiment the coal cutters work from the conveyor stretch 1 in the direction toward the coal front at an adjustable angle 3 of less than 90° so that the coal front Kf is undercut at this angle as measured with respect to the horizontal surface S. At this angle the coal front is undercut as has been illustrated in FIG. 3.

Figure 4:
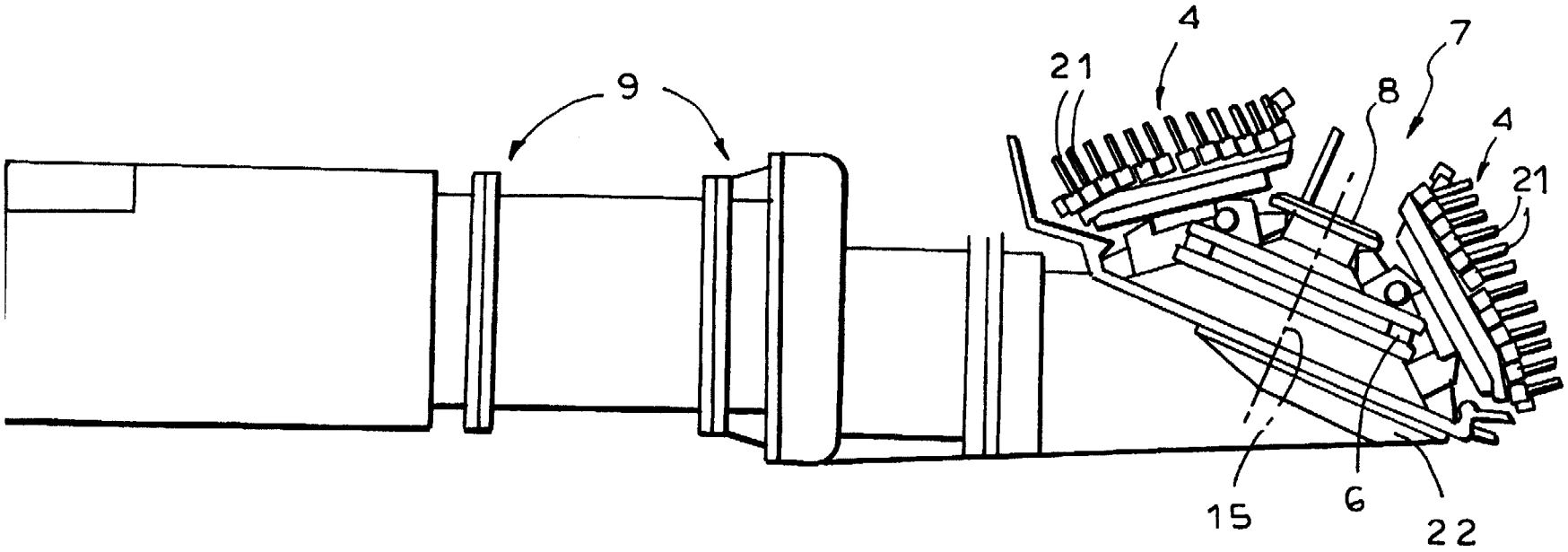
FIG. 4 is an elevational view, drawn to a larger scale of the portion f the machine shown at IV in FIG. 1 in the direction of the arrow.
Figure 5:
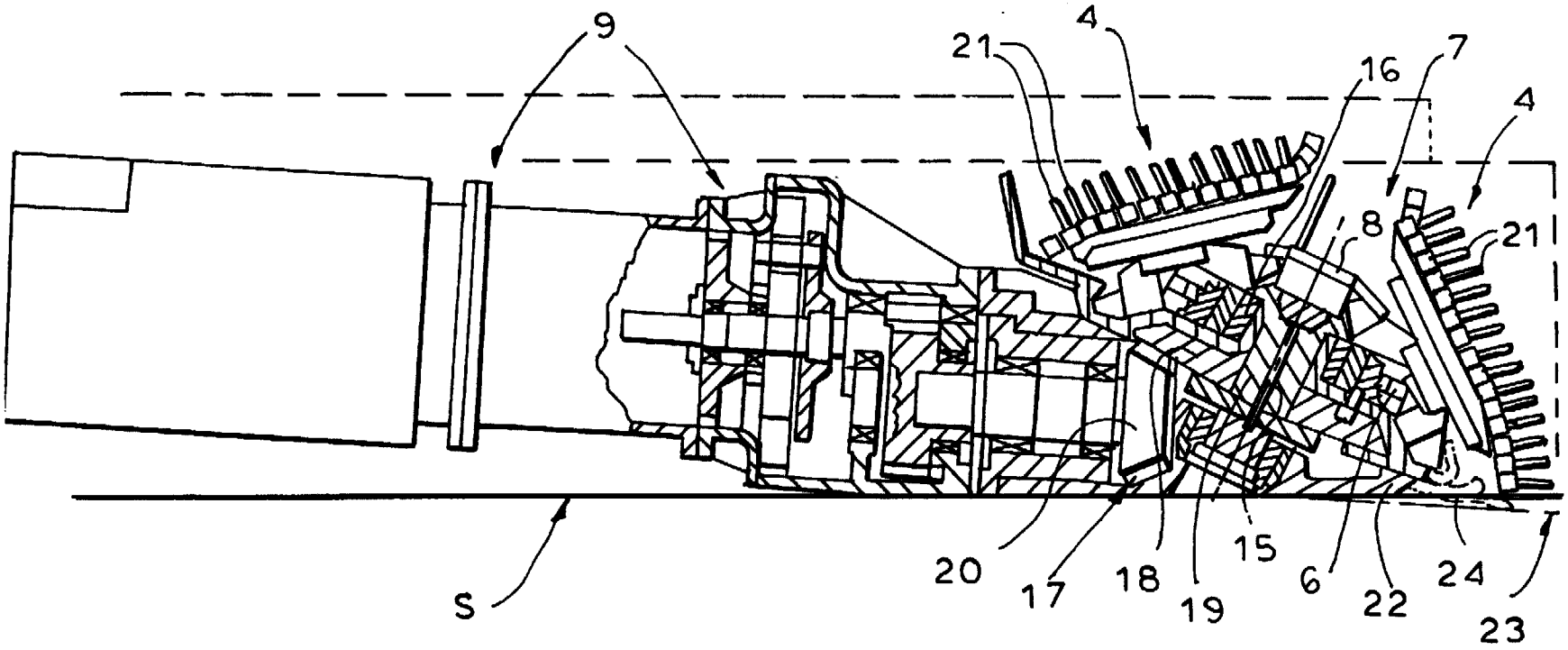
FIG. 5 is a view similar to FIG. 4 with part of the machine broken away in a longitudinal section.
Figure 6:
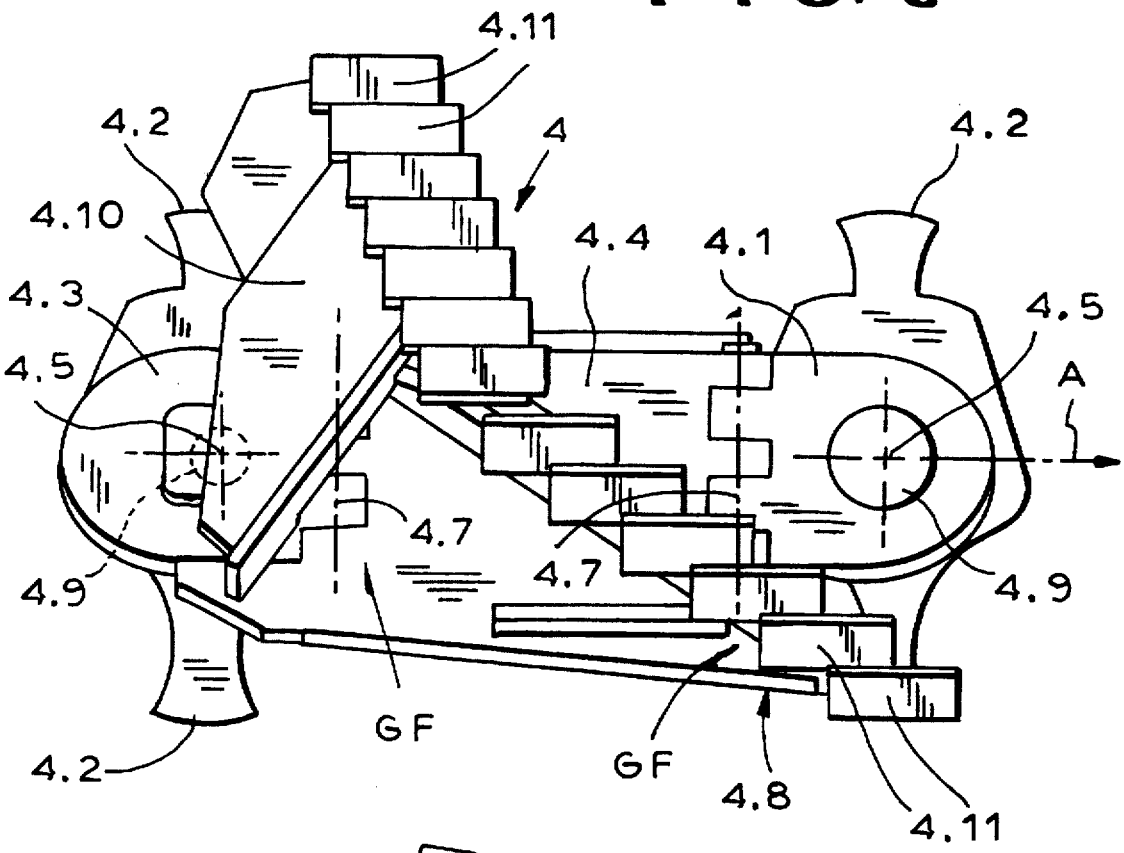
FIG. 6 is an elevational view drawn to a larger scale than FIG. 2, illustrating a plow or tool for use with the machine of the invention.

From FIGS. 4 and 5 it will be apparent that the shafts 15 of the reversal wheels at the reversing stations 7 have their axes inclined to the vertical by 10° to 45°, preferably about 3° to the direction of excavation. The bearing elements 16 are visible in FIG. 5. From FIGS. 1, 4 and 5, it will be apparent that motor/transmission unit 9 of the drive station extends as a linear unit along the gallery BS and hence the service tunnels. It is braced on the surface S. The shafts 15 of the direction reversal units 7 are connected to the motor/transmission unit 9 by a bevel gear transmission 17.

The motor/transmission unit 9 can also extend in the direction of the conveyor stretch or parallel thereto, although that has not been illustrated.

The troughs and the cable stretches in the respective troughs can be comparatively short as has been indicated in FIG. 1. The conveyor trough and the excavating trough together form a support rail 13 while the conveyor stretch and the excavating stretch can extend beyond this rail and the body formed by the two troughs. Because of the fact that the two troughs form a support rail over the full length of the coal face Kf and the rear side of this body is supported at 14 at an edge of the conveyor trough on the floor of the cut (represented at S in FIGS. 1 and 3), the structural stability of the body is sufficient to support the conveyor stretch 1 and the excavating stretch 2 in the region in which the latter plows coal from the coal front.

In the embodiment illustrated, the tools 4 are arranged at an angle of attack of about 80° advantageous in European mining operations and which has been found, in addition, to give rise to an increase in the excavation efficiency.

The friction losses are reduced when, for the reversing wheels 8 as has been illustrated in FIGS. 4 and 5, coaxial to the respective reversing wheel shaft 15, a driven bevel gear 18 is provided into which a stub 19 of the reversing shaft 15 can extend. The stub 19 is, of course, keyed to the driven bevel gear 18 and may be integral with the wheel 8.

The driven bevel gear 18 meshes with the output bevel gear 20 of the motor/transmission unit 9 which is configured as a linear drive. The bevel gear 20 is rotatable about an axis parallel to or coaxial with the motor axis.

FIG. 5 also shows that the tools 4, as they pass the drive stations 7 and around the reversing wheels 8 have horizontal or prone excavating picks 21 which project beyond the outline of the reversing wheel 8 and the housing 22 of the transmission. The rotation axes of the reversing wheels and thus the shafts thereof are so inclined to the vertical that the tools 4 at their deepest locations along their respective circulating paths, excavate a free cut region 23. On the machine or frame in the region of the drive station 7, skids 24 are provided on which the machine frame can slide and which ride on the floor of the free cut region 23.

The continuously operating mining machine of the invention also contains a number of other features which increase the efficiency of the machine without detrimentally affecting the compact construction. These are detailed in connection with FIGS. 6 through 10.

One of these features concerns the construction of the tools 4. A preferred embodiment of the tools 4 has been illustrated in FIGS. 6 and 7 which show that each of the tools is provided with additional articulation degrees of freedom represented at GF. Each excavating tool 4, for example, can have a leading piece or head 4.1 provided with two laterally extending guide formations 4.2, a trailing piece 4.3 with two laterally projecting guide formations 4.2, and a middle piece 4.4. The head piece 4.1 and the trailing piece 4.3 are hinged to the middle piece 4.4 by a respective hinge axis 4.7 which extends generally perpendicularly to the direction in which the chain 6 is tensioned, that direction being represented by the arrow A in FIG. 6. The additional hinge joints 4.7 and the pivot axes 4.5 connecting the formations 4.2 with the head piece 4.1 and the tail piece 4.3 are orthogonal to one another and orthogonal to the direction A.

In the regions of the reversal of the direction of the tools and the chain at 7, guide elements are arranged in which the formations 4.2 are guided.

The bolts 4.9 form the pivot axes 4.5 as described. The extra joints 4.5 and 4.7 have been found to be highly advantageous in preventing binding of the tools 4 as they pass around the reversing wheels 8 and to prevent binding of the tools within the excavating trough and the conveyor trough. The result is a further reduction in the friction losses and an improvement in the excavation efficiency.

Figure 7:
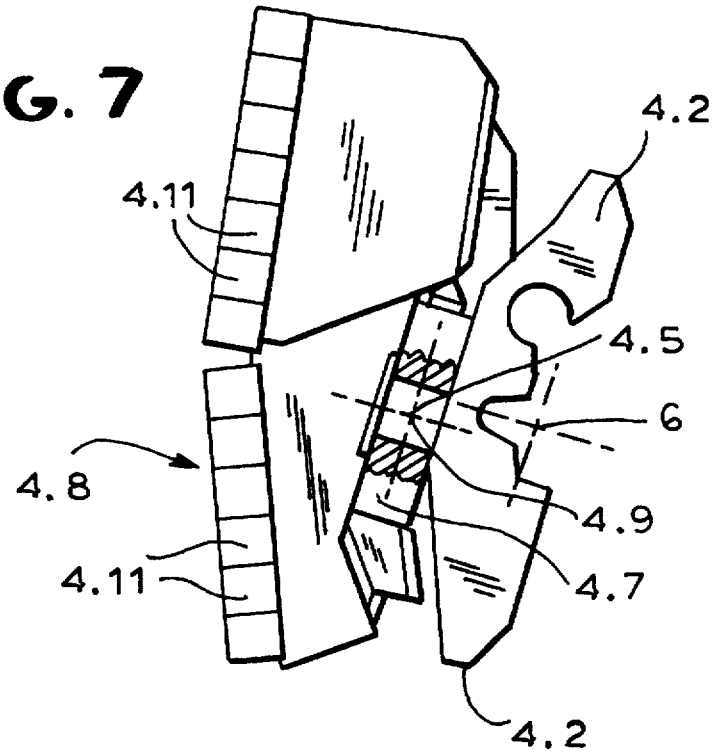
FIG. 7 is a side view of the tool of FIG. 6, partly in section.

FIG. 7 shows the basic elements of the tool 4 in which the excavating formations are represented at 4.11 and additional elements are provided at 4.10, for example, to function as conveyor elements. The attack face of the tool has been represented at 4.8 in FIG. 7. The members 4.11 are plows or picks as has been shown at 21 in FIG. 5, for example.

Figures 8, 9, 10:
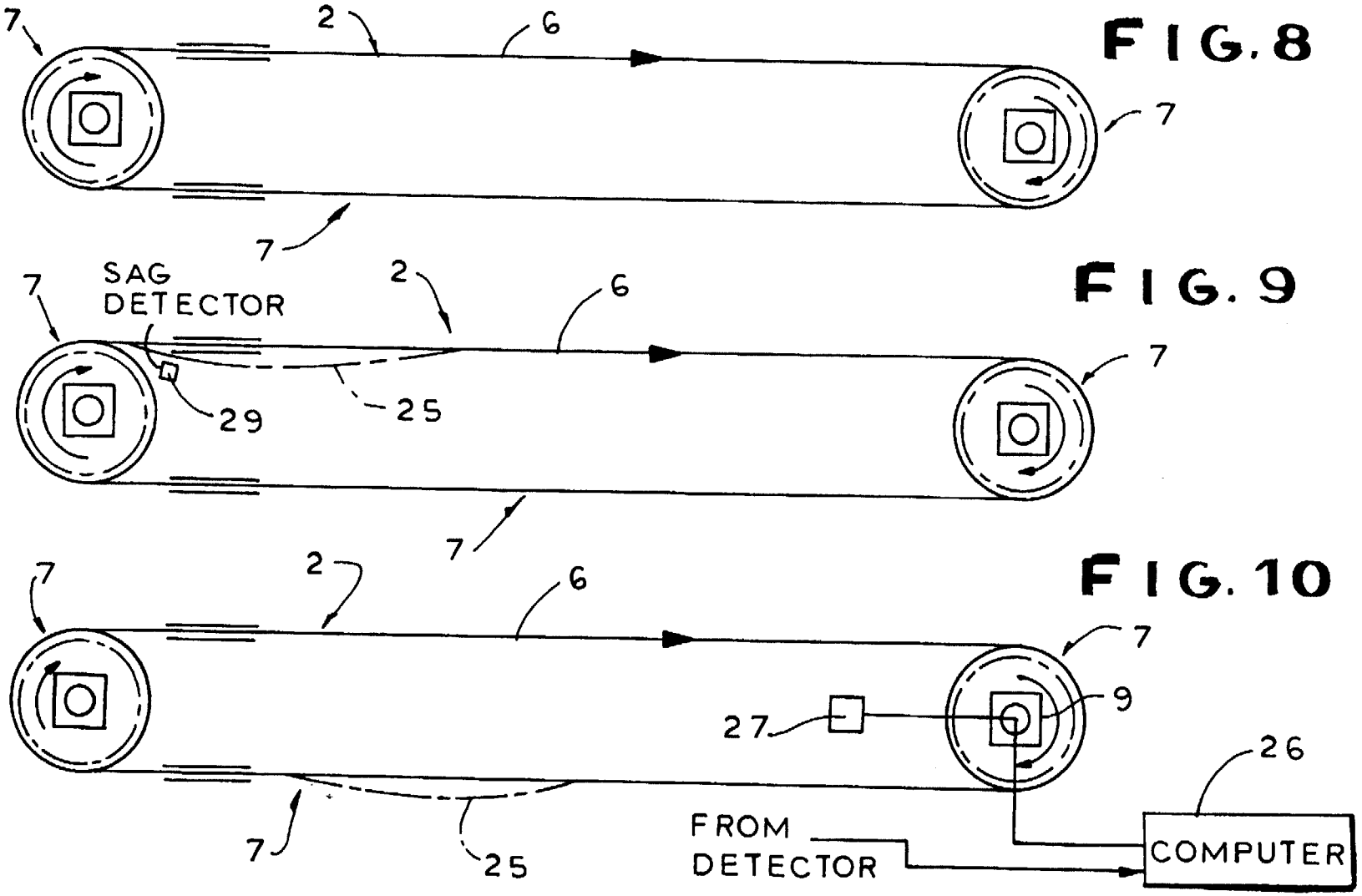
FIGS. 8–10 are diagrams serving for the description of the invention with means for avoiding the formation of chain sag.

Another feature in improving the efficiency has been shown diagrammatically in FIGS. 8 through 10 in which chain sag at 25 is to be precluded.

The formation of chain sag at 25 is a problem which arises where the chain 6 over its excavating stretch 2 has a greater tension downstream of a drive station than can develop in the conveyor stretch immediately upstream thereof. The chain 6 tends to elongate in the excavating stretch 2. At the upstream end of the excavating stretch 2, the links tend to accumulate and the result is high friction at the drive.

With the system of the invention, a device, for example, a sagged detector 29 can be provided and can supply an input to a computer 26 which can accelerate the drive area additional tension to the excavating stretch 2 and draw out the sag 25. This can be seen from a comparison of FIGS. 8, 9 and 10. In FIG. 8, for example, the chain 6 is so tensioned that there is no sag either in the excavating stretch 2 or in the conveying stretch 1.

In FIG. 9, however, incipient sag tends to develop at 25 and is detected. The computer 26 so operates the drive 9, it also can receive an input from a tachometer 27 measuring the speed of this drive, to pull out the sag in the excavating stretch and, if necessary, limit the sag to the conveying stretch 1 as has been shown in dot dash lines in FIG. 10. Other methods of determining sag can be used, namely, the detection of tension differences between the two stretches.

The angle between the troughs is unaffected by this mode of removing said in the excavating stretch nor is the technique for removing the sag effected by the angle used between the troughs. The use of two drive stations, one of which primarily serves the excavating stretch 2 and has a higher power than the other which primarily services the conveying stretch 1 and has a lower power is also advantageous.

This combination can preclude the formation of chain sag and facilitate the excavation of coal.

We claim:

1. A mining machine for mining a seam of coal between two galleries, comprising:

an elongated machine body extending between said galleries and provided with an endless chain carrying coal-excavating tools and adapted to be advanced against a coal face, said chain having an excavating stretch engaging said face and displaced in an excavating trough of said body and a conveying stretch displaced in a conveying trough of said body rearwardly of said excavating trough with respect to a direction of advance of said body, thereby excavating coal from said seam to form a cut and transferring excavated coal to one of said galleries;

respective direction-reversing wheels around which said chain passes at opposite ends of said stretches and at which said chain passes respectively from said excavating stretch to said conveying stretch and from said conveying stretch to said excavating stretch;

at least one drive unit operatively connected to one of said wheels, located in a respective one of said galleries and supported on a floor thereof, said drive unit comprising an electric motor and a transmission connected between said electric motor and said one of said wheels for driving said chain along said stretches, said excavating trough having an excavating trough bottom at an angle of 70° to 130° to a bottom of said conveying trough and forming a reinforcing rail for said body, said conveying trough being formed on side thereof opposite said excavating trough with a bearing edge supporting said body on a floor of the cut, said excavating stretch is positioned to undercut said coal seam, said wheels have shafts inclined upwardly and forwardly at angle of 10° to 40° to the vertical; and bevel gearing connecting said transmission to said one of said wheels.

2. The mining machine defined in claim 1 wherein the angle between said excavating trough bottom and said bottom of convey trough is about 100°.

3. The mining machine defined in claim 1 wherein the angle between a vertical and said shafts is about 35°.

4. The mining machine defined in claim 1 wherein said tools have an angle of attack against said coal face and undercutting said seam of less than 90° along said excavating stretch measured with respect to said floor of said cut and inclined upwardly and rearwardly with respect to said direction.

5. The mining machine defined in claim 1 wherein said drive unit is elongated and extends in a longitudinal direction of said one of said galleries.

6. The mining machine defined in claim 1 wherein said troughs and said reinforcing rail are of a length which is sufficiently stabilized by the support of said body on said bearing edge as to reliably position said stretches during excavation and conveying of excavated material from said seam.

7. The mining machine defined in claim 1 wherein said tools are oriented with an angle of attack of about 80° to said floor of the cut, inclined upwardly and rearwardly with respect to said direction upon within upon said coal face.

8. The mining machine defined in claim 1 wherein said driven bevel gearing includes a driven bevel gear coaxial with said shaft of said one of said wheels and said shaft of said one of said wheels extends into said driven bevel gear and a drive bevel gear meshing with said driven bevel gear and connected to said drive unit for rotation about an axis parallel or coaxial with an axis of said motor.

9. The mining machine defined in claim 1 wherein said tools have picks which, as said tools pass around said wheels become substantially prone and project beyond outlines of said wheels and housings of said drive unit and said bevel gearing and into deepest regions of the paths of said picks in which the substantially prone picks pass through a free cutting zone, the body of said machine being provided with skids which support said body in said free cutting zone.

10. The mining machine defined in claim 1 wherein said tools comprises a leading part having a pair of lateral guide formations, a trailing part with a pair of lateral guide formations repairing between said leading part and said trailing part connected with said middle part by respective hinge articulations, said guide formations being pivotally mounted on the respective parts by pivot axes orthogonal to said hinge articulations.

11. The mining machine defined in claim 1, further comprising means for detecting chain sag and a computer responsive to said means for detecting chain sag and controlling said drive unit to reduce said chain sag.

12. The mining machine defined in claim 11 wherein the chain sag is detected in said excavating stretch and said drive is operated to eliminate chain sag in said excavating stretch and accumulate any chain said in said conveying stretch.

* * * * *